United States Patent [19]

Boyd et al.

[11] 4,133,971

[45] Jan. 9, 1979

[54] HAND GRIP MOUNTED SWITCH AND STRAIN RELIEF

[75] Inventors: Wilton E. Boyd, Canton; Donald R. Bowers, Akron, both of Ohio

[73] Assignee: The Hoover Company, North Canton, Ohio

[21] Appl. No.: 766,894

[22] Filed: Feb. 9, 1977

[51] Int. Cl.[2] ..... A47L 9/32; H01H 9/06; B25G 1/00

[52] U.S. Cl. ..... 174/46; 15/DIG. 10; 200/157; 339/101; 339/103 R

[58] Field of Search ..... 174/46, 65 R, 65 G, 174/135, 153 G; 200/157; 339/58, 101, 103 R, 105; 15/361, 410, DIG. 10

[56] References Cited

U.S. PATENT DOCUMENTS

| | | | |
|---|---|---|---|
| 1,932,126 | 10/1933 | Allen | 174/46 |
| 2,171,331 | 8/1939 | Folsom, Jr. | 339/103 R |
| 2,183,310 | 12/1939 | Frantz | 200/157 |
| 2,218,161 | 10/1940 | Berg | 15/DIG. 10 |
| 2,662,110 | 12/1953 | Fiori | 174/153 G X |
| 2,712,119 | 6/1955 | Strubel | 174/153 G X |

*Primary Examiner*—Laramie E. Askin
*Attorney, Agent, or Firm*—The Hoover Company

[57] ABSTRACT

A floor care appliance or the like is provided with a hand grip having a switch retaining member that also serves as a portion of the means utilized for retention of a cord strain relief. The hand grip and handle on which it is mounted provide the remaining portions of the means for retention of the strain relief, while the handle also serves as a retaining means for the switch retaining member.

8 Claims, 6 Drawing Figures

HAND GRIP MOUNTED SWITCH AND STRAIN RELIEF

BACKGROUND OF THE INVENTION

1. Field of the Invention

This invention relates to a switch and strain relief assembly for use with a handle or hand grip of a floor care appliance or the like and, more specifically, relates to a handle, hand grip and switch retaining member arrangement for a vacuum cleaner where the just named elements cooperate to retain a switch and strain relief in firm, fixed position relative to a cleaner.

2. Description of the Prior Art

Although the use of switch retaining members such as plates and the like that are screwedly fastened to the handle or hand grip of a floor care appliance are old and well known, the same being generally used in conjunction with an electric cord strain relief mounted closely adjacent to the switch, heretofore the mounting of the strain relief and switch has generally been relatively independent. No advantage, then, has been taken of the fact that both a strain relief and an on-off switch are required for cleaner operation so that a cooperative mounting of these elements would tend to reduce the number of parts required for the total assembly, probably simplify manufacturing assembly and lend itself to a clean, effective overall design for the upper end of the propelling handle for a floor care appliance.

Moreover, such an assembly adapts itself to the use of plastic for formation of the hand grip arrangement and the use of plastic and current molding techniques yields a highly stylized hand grip configuration, both pleasing to the eye and much more functionally comfortable to the user. However, adoption of a molded plastic hand grip may make the mounting means used for the switch and strain relief a more critical arrangement. Unless concerned sections of the hand grip are undesirably thickened or perhaps altered in some other way, the use of a multiplicity of screws, rivets or similar fastening means causes too high or too many stress concentration points in the molded hand grip with a resultant less durable more easily cracked or broken hand grip configuration.

The design requirements, just briefly reviewed, are magnified in importance when the use of a rectangular handle is dictated by market appearance requirements and yet the hand grip must be both attractive and totally functional for the user.

Accordingly, it is an object of this invention to provide a strain relief-switch retention member assemblage where dependence of one or the other tends to simplify overall design requirements.

It is an additional object of this invention to provide direct, close cooperation between the handle, hand grip, strain relief and switch retaining member to accomplish the same end.

It is a further object of this invention to limit, as much as is practical, the use of retaining means that tend to provide high stress concentration points in the hand grip arrangement.

It is a still further object of the invention to provide a hand grip, handle, switch and strain relief assemblage where the hand grip may be formed of plastic and thus, both highly stylized and light in weight, yet durable and comfortable to the user's manual grasp.

It is yet another object of the invention to provide a configuration of strain relief, switch, switch retaining member and hand grip where the hand grip will mount to and function with a rectangular cross section handle.

SUMMARY OF THE INVENTION

The invention is situated in the environment of a sharp-angled cross section handle for a cleaner such as a rectangular cross sectioned handle and includes a highly stylized yet functional two piece hand grip. The hand grip pieces are also rectangular in their lower portions so as to fit within the handle and merge smoothly into functional, stylized grasping portions at their upper ends. The hand grip pieces are joined along a generally medial horizontal line through the grip with a lap joint formation yielding easy mating and reliable joint strength. These two parts are then permanently fastened together by ultrasonic welding or the like.

Each hand grip portion includes a series of transverse ribs which abut upon mating assembly and a pair of irregular stepped longitudinally extending ribs, situated in the area of switch mounting, that also abuttingly mate upon assembly. A transverse rib is provided in both hand grip portions at the rear or upper ends of the grip portions that join the elongated stepped ribs to strengthen the same and serve as a retention means as will be later explained.

The forward end of the lower grip portion also includes a series of three short transverse ribs that provide a tortuous passage for the electric cord passing down the cleaner handle and, thus, an integral strain relief on the hand grip. Above and axially rearwardly of this strain relief means is a screw receiving aperture that mates with a threaded boss on the other grip portion. A screw, advantageously, passes through an aperture in the lower face of the handle, the aperture in the lower grip portion and the aforesaid threaded boss to serve as the only active retaining means between the handle and hand grip.

Disposed above and longitudinally rearwardly of the described aperture the lower hand grip portion includes a generally trapezoidally shaped switch receiving cutout so that the switch may be inserted through the aperture formed. Integral generally horizontally extending lugs on the stepped ribs limit inward and axial movement of the switch body.

A forwardmost wall of this generally trapezoidal aperture includes a semi-circular cutout which is disposed immediately opposite a similar cutout in a switch-retaining member that covers the total general opening formed. A circular groove formed in the strain relief is mounted so as to be captured by the adjacent portions of the hand grip and switch retaining members by the surrounding circular aperture formed.

In order to maintain the switch-retaining member in place, its other end includes a radially inwardly extending post, including a one-way cam latch portion at its termination, that abuts against the transverse rib connecting the stepped ribs in the lower hand grip portion. At this location, the post latches over the inner termination of this rib to prevent its outward movement. At the same time because of the camming action, it is resiliently urged axially downwardly or forwardly so that the switch-retaining member tends to retain the strain relief by moving thereagainst so that it and the confronting portion of the strain relief forming the groove are jammed together, one against the other, with the handle maintaining this relationship since it also engages a part of the grooved portion and prevents removal of the strain relief unit the hand grip and handle are disengaged and the strain relief is moved axially a sufficient amount so as to clear the handle retention of it.

The upper hand grip portion includes an additional longitudinally extending rib which, in assembled position, is disposed between the switch contacts and their electrical connections, to isolate the same electrically. This rib may be of sufficient radial inwardly extending depth so as to serve as an additional means limiting inward movement of the switch body.

DESCRIPTION OF THE DRAWINGS

Reference may now be had to the accompanying drawings for a better understanding of the invention, both as to its organization and function, with the illustration being only exemplary, and in which.

DESCRIPTION OF THE PREFERRED EMBODIMENT

Figure 1:
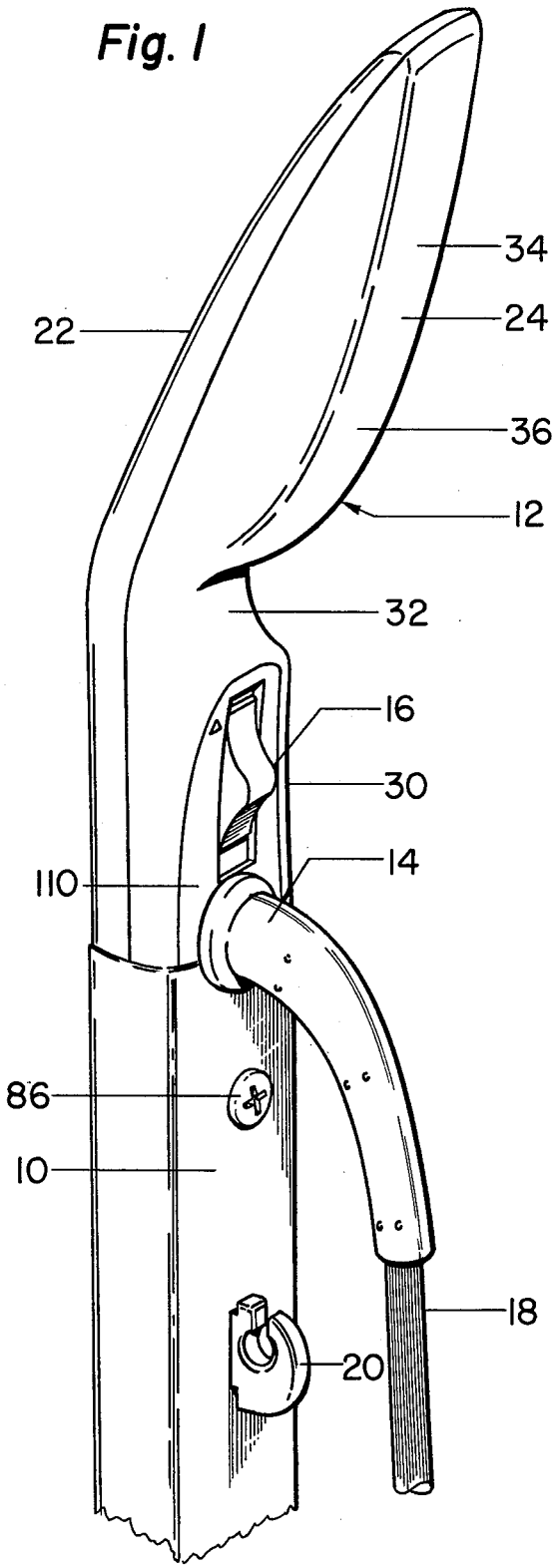
FIG. 1 is a perspective view of a floor care appliance handle utilizing the instant invention.
Figure 2:
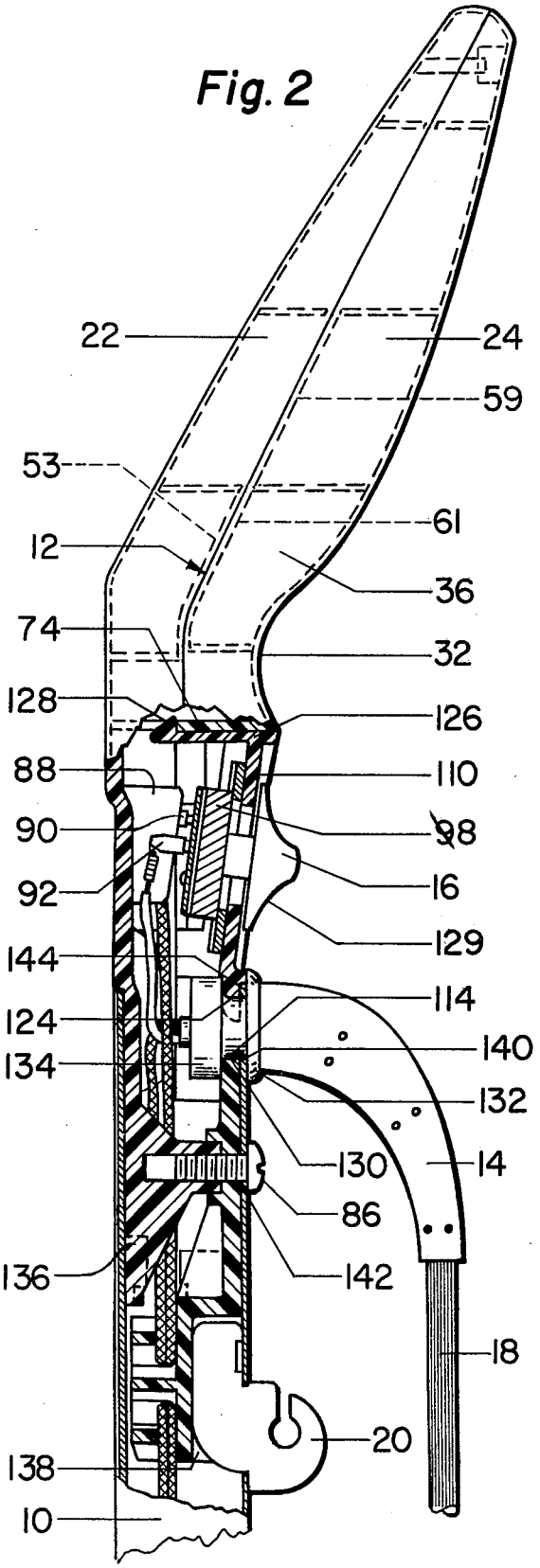
FIG. 2 is a broken side elevational view of the handle and included hand grip, with certain parts shown in phantom.
Figure 3:
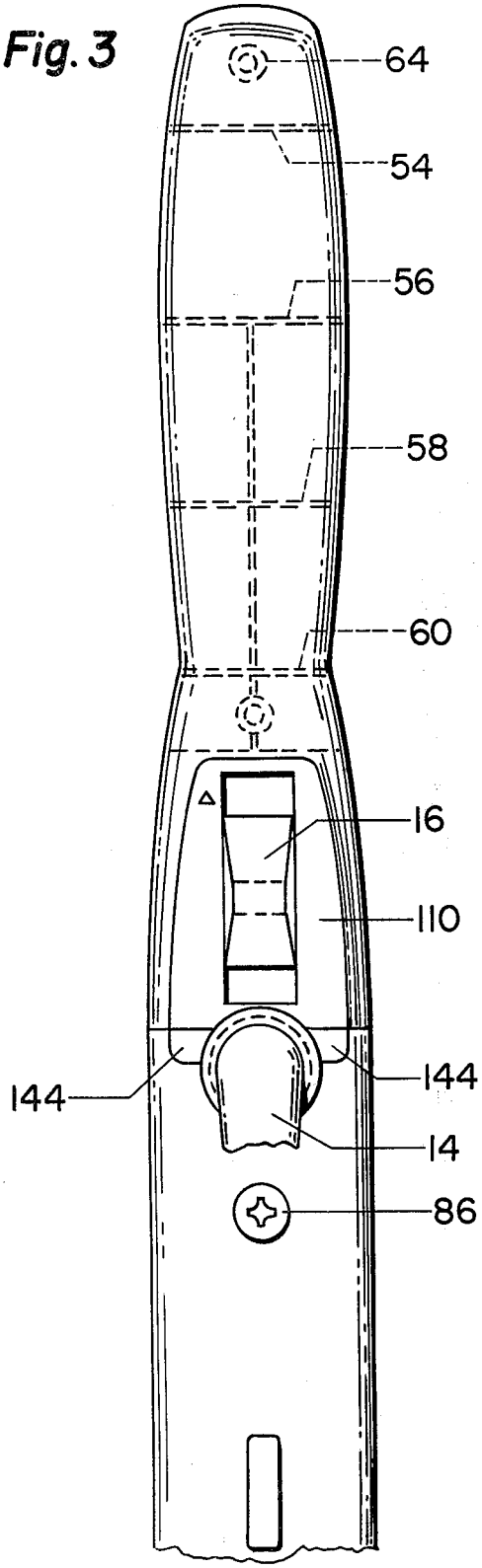
FIG. 3 is a bottom plan view of the structure shown in FIG. 1.

As is shown most clearly in FIGS. 1 and 2, a handle 10 for an electrical appliance (not shown) such as a floor care machine, is shown which includes a hand grip assembly 12, a strain relief 14 and a switch 16 for closing the circuit for the floor care appliance, the supply of current being provided by an electrical cord 18 including a plug (not shown) for securement to a wall socket (not shown).

The handle 10 is generally rectangular in cross section to provide a modern appearance and provides a convenient conveying means for conventionally leading the electrical cord 18 downwardly within the handle 10. A bag hook 20 is provided on handle 10 for support of cord 18 when the same is not in use. The lower portion of the handle 10 may, of course, be attached, conventionally, to a bail or the like (not shown) of a vacuum cleaner. Such a connection, both electrical and mechanical, may take many forms and is not further described here since the same is well known and clearly taught in the prior art.

Turning to the more inventive aspects of the instant Application, it can be seen that the hand grip 12 is comprised of upper and lower mating pieces 22 and 24, respectively, of generally semi-tubular configuration. These two hand grip pieces are mounted in abutting relationship with their open sides 26 and 28, respectively, in confronting relationship so that a closed shaped configuration is obtained. This shape includes a lower, inner portion 30 of the hand grip of rectangular cross section in configuration, an intermediate portion 32 of necked down configuration and an upper, outer portion 34, shaped conveniently for the grasp of the user of the floor care appliance and being roughly circular in its cross section and including a bulbous portion 36 adjacent necked down portion 32.

Figure 4:
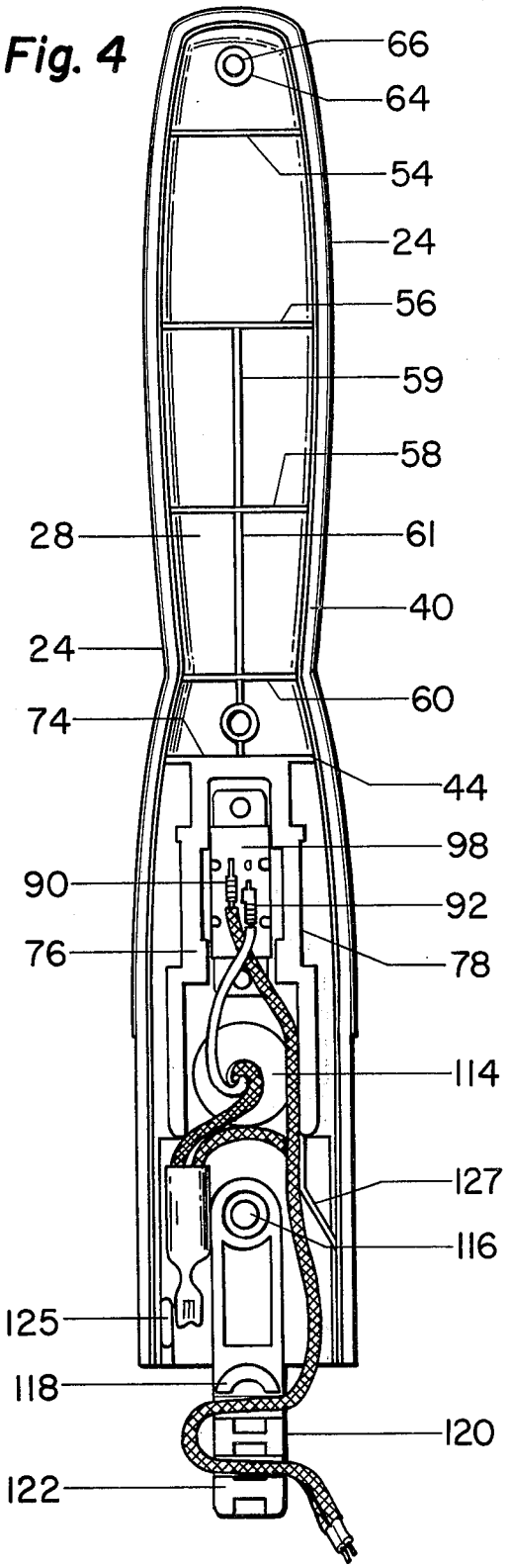
FIG. 4 is a top plan view of the lower hand grip half, switch, wires and strain relief.
Figure 5:
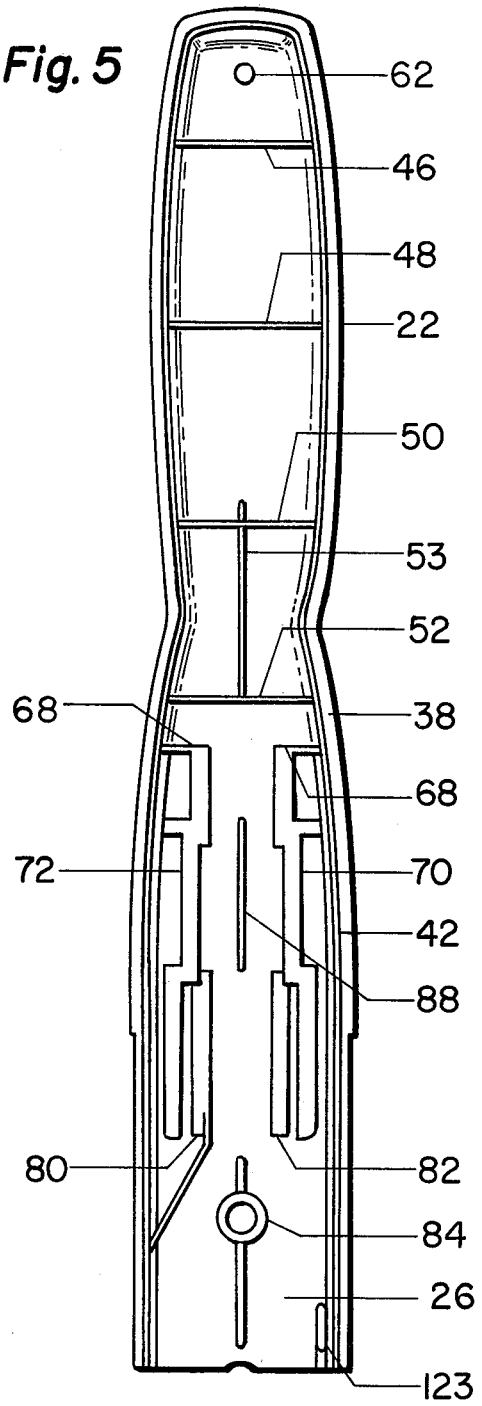
FIG. 5 is a bottom plan view of the upper half of the hand grip.

Hand grip pieces 22 and 24 can best be seen in their unassembled state in FIGS. 4 and 5 and include generally horizontal flange portions 38, 40 and vertical flange portions 42, 44, respectively, with vertical flange portion 42 formed on the inner periphery of the shell form of upper hand grip piece 22 and vertical flange portion 44 formed on lower hand grip piece 24 at its shell outer periphery. By this arrangement, when the hand grip pieces 22 and 24 are in assembled position, a lap joint is formed at the mating juncture of the two pieces to provide a reasonably rigid total assembly.

Upper hand grip piece 22 also includes a series of transversely extending ribs 46, 48, 50 and 52 and a longitudinal rib 53 which merge smoothly into the shell form of lower hand grip piece 22. These ribs serve to strengthen hand grip piece 22. Hand grip piece 24 also includes a series of transversely extending, slightly angled strengthening ribs 54, 56, 58 and 60 and longitudinal ribs 59, 61. These ribs only strengthen their individual hand grip pieces and do not serve as abutting members upon hand grip assembly 12, as they terminate short of each other so as to be spaced from each other when in assembled condition, as can be seen from the dashed lines in FIG. 2.

At its upper, outer end, hand grip assembly 12 includes an attaching means maintaining the two hand grip pieces together at their upper distal ends. This attaching means takes the form of an internal pin 62, integral with and extending angularly inwardly from upper hand grip piece 22 and a hollow boss 64 also extending angularly inwardly but integral with lower hand grip piece 24. A bore 66, formed in boss 64, is dimensioned so as to receive pin 62 in a relatively tight manner so as to fix the two hand grip parts together.

Forwardly of transverse ribs 46, 48, 50 and 52 on upper hand grip piece 22 is another transverse rib 68 that is an intermittent rib open in the middle, but it is an integral portion of a pair of stepped ribs 70, 72 extending generally aligned and axially of the hand grip piece 22. In a similar manner, lower hand grip piece 24 includes an additional transverse, continuous full rib 74, joined to a pair of aligned axially extending stepped ribs 76, 78. These ribs abut with their counterparts on upper hand grip piece 22 when the hand grip 12 is in assembled condition, because these ribs are flush with the inner termination of vertical flange 44 on hand grip piece 24, while ribs 68, 70 and 72 are flush with the inner termination of horizontal flange 38 of upper hand grip piece 22. This tortuous rib configuration and abutting relationship provides additional strength to the hand grip assembly 12 at the location of switch 16.

The remainder of the formation of upper hand grip piece 22 includes a pair of inner longitudinally extending ribs 80 and 82, disposed between the widest separation of the stepped ribs 70 and 72, to provide an additional strengthening in the area of the handle adjacent the strain relief 14. Forwardly of these two ribs is an inwardly extending boss 84 that receives a threaded screw 86 (FIG. 2) to maintain the lower, inner end of hand grip piece 22 in assembled condition. A mediately disposed, inwardly extending rib 88 may serve as an inward limiting, abutting means for switch 16 and does electrically isolate (FIG. 2) the conductor retaining contacts 90, 92 from each other upon final assembly.

Lower hand grip piece 24 (FIG. 6) is completed in form by a series of generally horizontal aligned tabs 94, 94, 96, 96 (FIG. 6), integral with the stepped ribs and extending outwardly thereof to provide a positive limiting means for inward movement of a switch body 98 of switch 16. These tabs are horizontally stepped at 100, 100 and 102, 102 to provide an inner offset planar surface 104 on which the inner of rear end of the switch body 98 rests, thus also limiting axial movement of the switch body relative to the hand grip 12.

Figure 6:
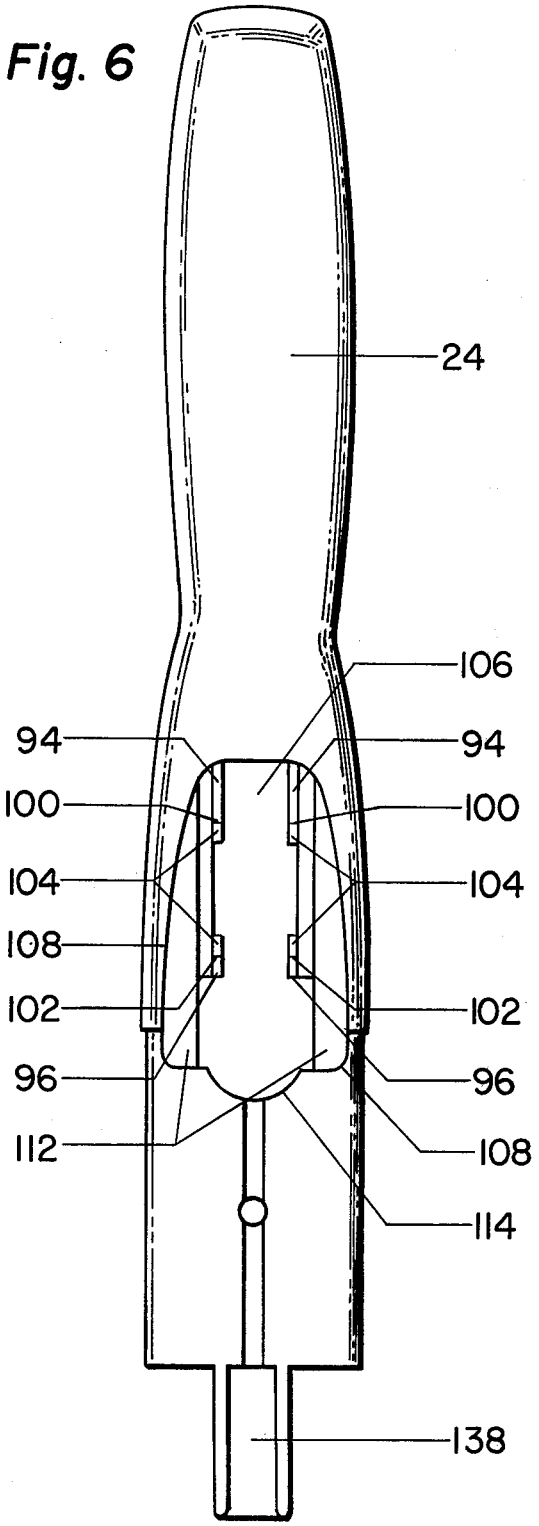
FIG. 6 is a bottom plan view of the lower hand grip piece.

As can also be seen in FIG. 6, a generally rectangular bottom opening aperture 106 is provided in lower hand grip portion 24 for insertion of the switch 16. A slightly larger aperture 108 of generally truncated shape and extending through only the shell of the lower hand grip portion 24 thereby provides a mount for a switch-retaining member 110, the same resting on generally planar faces 112, 112 formed on the shell of this hand grip piece when assembled with the hand grip assembly 12. The aperture 108 tapers from its inner, lower end towards its rear open end in a converging manner so as to provide easier ingress at the front end (cord end) of the aperture 108 to the cavity within the hand grip 12. At the front end of the aperture 108, there is also an absence of internal ribs or ribbing to again conveniently provide easier ingress to the interior of the hand grip 12 in the area of cord insertion. To this end, larger aperture 108 also includes a semi-circular cutout 114 at its front end that provides for passage of strain relief 14 and its cord 18 into the hand grip 12.

Forwardly of the larger aperture 108, the lower hand grip piece (FIG. 4) is formed with a screw-receiving aperture 116 extending through the shell of this piece for reception of the aforementioned threaded screw 86. Again, forwardly of this aperture, are a series of short, integral transverse ribs 118, 120, 122 around and between which the electrical cord 18 is wound to provide a tortuous path for strain relief purposes prior to the cord 18 passing downwardly through the handle 10.

Strengthening rib member 123, on upper hand grip piece 22 and strengthening rib member 125, on lower hand grip piece 24, formed at the forward inner ends of these hand grip pieces provide strength and support in this area to rigidify the overall structural integrity of hand grip 12 at its forward end. A lead-in rib 127 on the hand grip piece 24 provides a guided pathway for the wires extending downwardly in the handle. The structure of the hand grip 12 has now been completely described relative to the hand grip pieces 22, 24 and their relationship to each other. In order to insure that these two pieces are held tightly together once mounted with each other, an ultrasonic welding process is utilized which welds these pieces along horizontal flanges 38, 40 and vertical flanges 42, 44. The interengaging pin 62 and boss 64 are also ultrasonically fastened together in this same manner as well as the stepped ribs 70, 76 and 72, 78.

Switch-retaining member 110 is of generally horizontal extent and includes a semi-circular cutout 124 at its forward, inner end and disposed, when switch-retaining member 110 is assembled with hand grip 12, to be in confronting relationship with semi-circular cutout 114 in lower hand grip piece 24. The remainder of the external periphery of the general horizontal extent of switch-retaining member 110 conforms to the roughly truncated aperture 108, while its depth is of such dimensioning as to place it flush with the general external periphery of the hand grip 12 when the switch-retaining member 110 rests at the faces 112 of the lower hand grip portion 24.

The end of switch-retaining member 110, opposite semicircular cutout 124, includes an integral, inwardly extending post 126 having a one-way cam latching shoulder 128 formed on its inner end, with the cam of wedge shape and this shape being disposed on the rearward, upper side of the latching post. Upon insertion of the switch-retaining member 110 into truncated aperture 108, the cam latching shoulder 128 is caused to slide along rib 74 of the lower hand grip portion, between stepped ribs 76, 78, until the cam latching shoulder 128 latches over the radially inward termination of rib 74.

In order to properly interengage strain relief 14, lower hand grip piece 24 and switch-retaining member 110, the switch-retaining member 110 and strain relief 14 must be inserted within truncated aperture 108 somewhat simultaneously to make these elements captive with the lower hand grip piece and hand grip assembly 12. To this end, a circular, peripheral groove 130 is formed in the strain relief 14 and is bordered axially outwardly relative to the strain relief groove 130 by a cap flange 132 and with a disc portion 134 axially inwardly of this same groove. The diameter of the internal circumference of groove 130 is substantially the size of the circular aperture formed by confronting semi-circular cutouts 114, 124, while its thickness or depth is sufficient to be slightly more than the combined thicknesses of the wall of the lower hand grip piece 24 and the wall thickness of the handle 10.

Assembly of the strain relief 14 with the hand grip assembly 12 and switch-retaining member 110 occurs in the following manner: the groove 130 of the strain relief is nested in semi-circular cutout 114 of the lower hand grip piece 24; the semi-circular cutout 124 of the switch-retaining member 110 is nested in the opposite side of this groove and the post 126 is inserted through truncated aperture 108 so that cam latching shoulder 128 of it may ride along the forward side of rib 74. The switch-retaining member 110 is then pushed home to its fully inserted position causing the cam latching shoulder 128 to reach the aforementioned latching position. A removable cap 129 is then mounted on switch 16 to aid in operation manipulation.

Because of the inherent resiliency of the strain relief 14 and the fact that the switch retaining member 110 is tightly positioned between it and the rib 74 and since the latching post 126 also has some inherent resiliency, the switch retaining member 110 is, in effect, jammingly or wedgingly maintained in its assembled position with the post 126 tending to urge the switch retaining member 110 axially towards the strain relief 14. This helps maintain it in engaged position with semi-circular cutout 114 thereby effectively mating it with the hand grip 12, proper.

The handle-hand grip assembly configuration is completed by insertion of an inner end 136 of hand grip assembly 12 and attached parts into the upper open end of handle 10, this inner end being of slightly smaller dimension than the external exposed hand grip portion to provide a flush continuation between the handle and exposed hand grip. A well 138 in the hand grip assembly 12 slides over inner terminations of the cord hook 20 to aid in the aforesaid insertion.

A semi-circular cutout 140 is also provided in this end of the handle 10, the periphery of which mates in the circular groove 130 in the strain relief 14 with the handle 10 also encompassing forwardmost portions 144, 144 of switch retaining member 110. The screw 86 is then passed through a circular aperture 142 in handle 10, the screw receiving bore 116 in lower hand grip part 24 and is threadedly received in boss 84 in upper hand grip part 22.

The assembly of the handle 10 to the hand grip assembly 12 is, thus, completed with the screw 86 preventing axial separation between them. Since the handle 10, in this position, overlaps the portions 144, 144 of switch retaining member 110 and the hand grip assembly 12, it prevents radial outward movement of any of them at their forward ends. Thus, the hand grip assembly 12 and switch retaining member 110 are held in their jammed position by the handle, both, because of fixed axial positioning and because of overlapping radial contact.

Only a single screw or the like is thereby required for the completed assemblage of this invention, simplifying construction, simplifying assembly, providing a stylized molded hand grip and, at the same time, limiting stress concentration points occasioned by the use of a multiplicity of conventional fasteners.

It should, therefore, be obvious that the objects of the invention have been complied with by the specific embodiment described. It should also be obvious that many deviations and variations of the disclosed invention could be made by one skilled in the art which would still come within the scope and purview of the description.

What is claimed is:

1. A handle arrangement for an electrical appliance, the combination including;

(a) a switch mounted with said handle arrangement,
(b) a switch retaining member holding said switch in its mounted position,
(c) a strain relief mounted with said handle arrangement,
(d) said switch retaining member including a portion having a cutout,
(e) said handle arrangement also including a portion having a cutout,
(f) said cutout portions confronting each other and capturing said strain relief therebetween,
(g) said switch retaining member including means jammingly engaging said handle arrangement for compressive urging of said cutout portion of said switch retaining member against said strain relief,
(h) said means jammingly engaging said handle arrangement comprising an inwardly extending post,
(i) said post engaging against an abutment means fixed relative to said handle arrangment,
(j) said post including, at its inner end, a latching shoulder, and
(k) said shoulder engaging over said abutment means to thereby limit outward movement of said switch retaining member relative to said handle arrangement.

2. A handle arrangement for an electric appliance, the combination including;

(a) a switch mounted with said handle arrangement,
(b) a switch retaining member holding said switch in its mounted position,
(c) a strain relief mounted with said handle arrangement,
(d) said switch retaining member including a portion having a cutout,
(e) said handle arrangement also including a portion having a cutout,
(f) said cutout portions confronting each other and capturing said strain relief therebetween,
(g) said switch retaining member including means jammingly engaging said handle arrangement for compressive urging of said cutout portion of said switch retaining member against said strain relief,
(h) said handle arrangement including a two piece molded hand grip,
(i) said switch retaining member being mounted on said hand grip of said handle arrangement,
(j) said handle arrangement including a tubular handle part,
(k) said molded hand grip being in telescoped relation with said tubular handle part,
(l) said tubular handle part including a means jamming against said strain relief at an end of it opposite its distal end, and
(m) said means jamming against said strain relief on said tubular handle part urging said strain relief toward said cutout portion on said switch retaining member.

3. A handle arrangement for an electrical appliance, said handle arrangement having an axial direction, the combination including;

(a) a switch mounted with said handle arrangement,
(b) a switch retaining member holding said switch in its mounted position;
(c) a strain relief mounted with said handle arrangement,
(d) said switch retaining member including a portion having a cutout,
(e) said handle arrangement also including a portion having a cutout,
(f) said cutout portions confronting each other and capturing said strain relief therebetween,
(g) said switch retaining member including means jammingly engaging said handle arrangement for compressive urging of said cutout portion of said switch retaining member axially against said strain relief,
(h) said means jammingly engaging said handle arrangement comprising an inwardly extending post, and
(i) said post engaging against an abutment means fixed relative to said handle arrangement to provide said axial urging, one of said post and said abutment means being resilient and bendingly engaging the other.

4. A handle arrangement for an electrical appliance, the handle arrangement having an axial direction, the combination including;

(a) a switch mounted with said handle arrangement,
(b) a switch retaining member holding said switch in its mounted position,
(c) a strain relief mounted with said handle arrangement,
(d) said switch retaining member including a portion having a cutout,
(e) said switch retaining member including means jammingly engaging said handle arrangement for compressive axial urging of said cutout portion of said switch retaining member against said strain relief,
(f) said means jammingly engaging said handle arrangement comprising an inwardly extending post, and
(g) said post engaging against an abutment means fixed relative to said handle arrangement to provide said axial urging, one said post and said abutment means being resilient and bendingly engaging the other.

5. A handle arrangement for an electrical appliance, the combination including;

(a) a switch mounted with said handle arrangement, (b) a switch retaining member holding said switch in its mounted position, (c) a strain relief mounted with said handle arrangement, (d) said switch retaining member including a portion having a cutout, (e) said handle arrangement also including a portion having a cutout, (f) said cutout portions confronting each other and capturing said strain relief therebetween, (g) a tubular handle part, (h) said tubular handle part telescoping over said handle arrangement, (i) said tubular handle part including a means jamming against said strain relief to urge it towards said switch retaining member.

6. The handle arrangement for an electric appliance as set out in claim 5 wherein;

(a) said tubular handle part overlaps a portion of said switch retaining member to limit its outward movement.

7. The handle arrangement for an electric appliance as set out in claim 6 wherein;

(a) a means attaching said tubular handle part to said handle arrangement to limit longitudinal movement of said handle arrangement relative to said tubular handle part is provided, whereby said strain relief is compressingly maintained affixed to said handle arrangement.

8. A switch retaining plate, switch, abutment means and strain relief combination including;

(a) said switch retaining plate having a generally planar expanse, (b) an aperture extending through said generally planar expanse, (c) a switch extending through said aperture, (d) a finger on said switch retaining plate projecting generally perpendicularly to said generally planar expanse, (e) one of said finger and said abutment means being resilient, bendable and deformable so that, upon deformation of one of said finger and said abutment means, said switch retaining plate is urged against said strain relief.

* * * * *